US006021616A

United States Patent [19]

Mayle

[11] Patent Number: 6,021,616

[45] **Date of Patent: *Feb. 8, 2000**

[54] ROOFING MEMBRANE WITH EXTERNAL TABS

[76] Inventor: Robert L. Mayle, 2047 Hyde Rd., Port Clinton, Ohio 43452

[ * ] Notice: This patent is subject to a terminal disclaimer.

[21] Appl. No.: 09/173,054

[22] Filed: Oct. 15, 1998

Related U.S. Application Data

[60] Continuation of application No. 09/063,550, Apr. 21, 1998, Pat. No. 5,850,719, which is a division of application No. 08/679,682, Jul. 11, 1996, Pat. No. 5,775,052.

[51] Int. Cl.[7] ..... E04B 7/00

[52] U.S. Cl. ..... 52/408; 52/58; 52/746.11; 52/557

[58] Field of Search ..... 52/746.11, 96, 52/58, 60, 408, 409, 748.1, 748.11, 521, 557, 559

[56] References Cited

U.S. PATENT DOCUMENTS

| | | | |
|---|---|---|---|
| 322,153 | 7/1885 | Blair et al. | 52/746.11 X |
| 835,889 | 11/1906 | Moeller | 52/521 |
| 2,151,794 | 3/1939 | Peebles | 52/553 X |
| 3,054,222 | 9/1962 | Buckner | 52/543 |
| 3,566,562 | 3/1971 | White | 52/748.1 X |
| 3,763,605 | 10/1973 | Freeman | 52/58 |
| 3,894,376 | 7/1975 | Shearer | 52/748.1 X |
| 4,112,632 | 9/1978 | Simpson | 52/60 X |
| 4,217,742 | 8/1980 | Evans | 52/553 |
| 4,226,069 | 10/1980 | Hinds | 52/521 |
| 4,493,175 | 1/1985 | Coppola, Jr. | 52/410 |
| 4,603,517 | 8/1986 | Lyons, Jr. | 52/60 |
| 4,635,409 | 1/1987 | Vandemore | 52/60 |
| 4,671,036 | 6/1987 | Sullivan | 52/746.11 X |
| 4,712,348 | 12/1987 | Triplett et al. | 52/408 |
| 4,718,211 | 1/1988 | Russell et al. | 52/409 |
| 4,799,986 | 1/1989 | Janni | 52/58 X |
| 4,860,514 | 8/1989 | Kelly | 52/410 |
| 4,870,796 | 10/1989 | Hart et al. | 52/409 |
| 4,872,296 | 10/1989 | Janni | 52/58 |
| 5,027,572 | 7/1991 | Purcell et al. | 52/410 X |
| 5,031,374 | 7/1991 | Batch et al. | 52/58 X |
| 5,065,553 | 11/1991 | Magid | 52/58 |
| 5,077,943 | 1/1992 | McGady | 52/58 |
| 5,218,793 | 6/1993 | Ball | 52/62 |
| 5,365,709 | 11/1994 | Lassiter | 52/408 |
| 5,452,553 | 9/1995 | Clapp et al. | 52/408 |
| 5,570,553 | 11/1996 | Balkins | 52/748.1 X |
| 5,586,414 | 12/1996 | Tawzer | 52/96 X |
| 5,706,610 | 1/1998 | Mayle | 52/60 |
| 5,775,052 | 7/1998 | Mayle | 52/746.11 |
| 5,850,719 | 12/1998 | Mayle | 52/408 |

OTHER PUBLICATIONS

GenFlex Product Details for Field Fabricated Outside Corner.

Jan. 1, 1993, Technical product literature from Duro–Last, Inc.

*Primary Examiner*—Laura A. Callo

*Attorney, Agent, or Firm*—Standley & Gilcrest LLP

[57] ABSTRACT

A roofing membrane for installation on a roof or parapet. Tabs are affixed to the outside of the roofing material which fold back to allow insertion of a fastener. The ends of the roofing material are first fastened to the roof or parapet to be covered. The intervening portion of the roofing material is then fastened. The tabs affixed to the outside of the roofing material cover the fasteners and can be sealed shut to waterproof the roofing material.

4 Claims, 2 Drawing Sheets

ROOFING MEMBRANE WITH EXTERNAL TABS

This application is a continuation of application Ser. No. 09/063,550, filed Apr. 21, 1998, now U.S. Pat. No. 5,850,719 which is a divisional of application Ser. No. 08/679,682, filed Jul. 11, 1996 now U.S. Pat. No. 5,775,052.

BACKGROUND AND SUMMARY OF THE INVENTION

This invention relates to a method of attaching roofing material in sheet form to horizontal roof decks (substrates) and vertically extending roof structures or walls (i.e., parapet) requiring less manpower and time-consumption, while achieving the desired result of securely attaching roofing material that is water-tight and wind-resistant.

Known methods of installing roofing material are time-consuming and require the use of two or more installers. In known methods, tabs are attached to the inside surface of the roofing material. Each tab is installed to the roofing material via a fastener, or anchor (e.g., a screw, nail, or any other equivalent fastening means). A fastener is driven through the tab and into the roofing substrate thereby securely attaching the material to the roof. The first fastener is installed on the horizontal roof substrate just before the material makes a right angle turn to climb the parapet. One or more installers are required to hold the roofing material up, or away, from the roof substrate and/or the parapet while another worker is required to pull the tab taut against the roof substrate. In this position, an additional worker can then fasten the tab to the roof substrate. As discussed, this process requires at least two to three workers. Additionally, this method requires a significant amount of time as the process is inherently cumbersome. Accordingly, a new and reliable process of installing roofing material is needed which can be performed by one installer, thereby significantly decreasing the cost and time of installing roofing material.

The method of the present invention for installing roofing material involves the use of a roof membrane which is comprised of a sheet of roofing material which may have tabs affixed to its outer surface. The ends of the roofing material are first fastened to the wall or roof substrate to be covered. The ends of the roofing material are fastened by tabs which are affixed to the underside of the roofing material. The portions of the roofing material between the fastened ends are fastened to the wall or roof substrate by installing fasteners directly through the roofing material into the wall or roof substrate to be covered. Tabs are affixed to the outer surface of the roofing material which can be folded back so that fasteners can be installed directly through the roofing material. Once fastened, the tabs can be folded back into place to cover the fasteners. The tabs may then be welded, or otherwise sealed, shut so that the roofing material is protected from rain, water, and other elements. The present method of installing roofing material saves significant time since the tabs affixed to the outside surface allow the roofing material to be fastened by one worker (there is no need for another worker to lift and hold the roofing material while fastening). Additionally, the roof membrane of the present invention can be pulled taut one sheet at a time, whereas the known methods require each tab to be pulled taut for each intervening tab.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DESCRIPTION OF THE PREFERRED EMBODIMENT

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
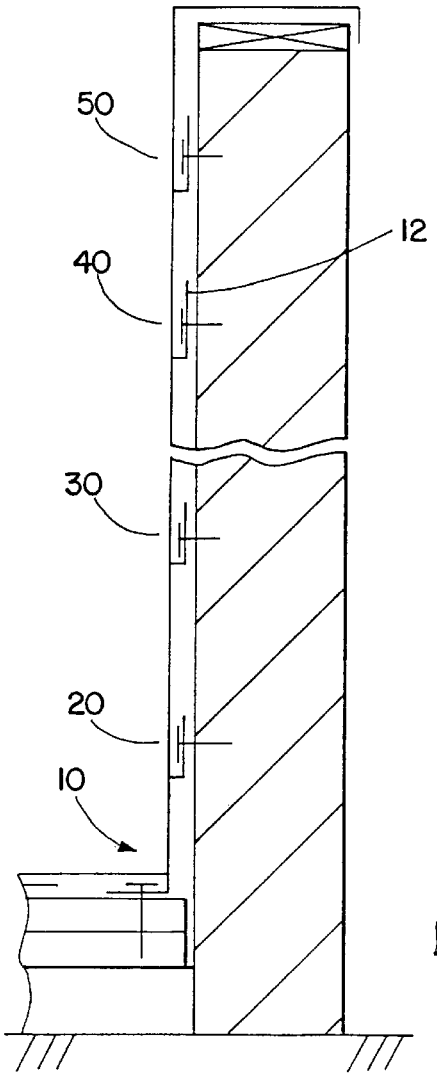
Fig. 1 (PRIOR ART)
FIG. 1 is a cross-sectional view of a parapet showing the installation of roofing material on a parapet and a portion of the horizontal roof deck substrate using a known method.

FIG. 1 illustrates the installation of roofing material on a wall (or parapet) using a method known in the art whereby the first fastener is installed at 10 and subsequent fasteners are installed in sequence at predetermined intervals 20, 30, 40 and 50. All fasteners are inserted through tabs which are attached to the underside surface of the roofing material closest to the roof or wall being covered. (Reference number 12 refers to a tab on the underside surface of a known roofing material.) These previously known methods of roofing require at least two workers to install the roofing material. For proper installation, since all the tabs of the known roofing materials are located on the underside of the roofing material, at least one worker is needed to pull the roofing material taut against the roof substrate and/or the wall to be covered, while another worker must position himself so as to be able to insert a fastener through the tab and drive the fastener into the roof substrate or wall. (An additional worker is often needed to hold the roofing material up or away from the worker pulling the tab.)

Figure 4:
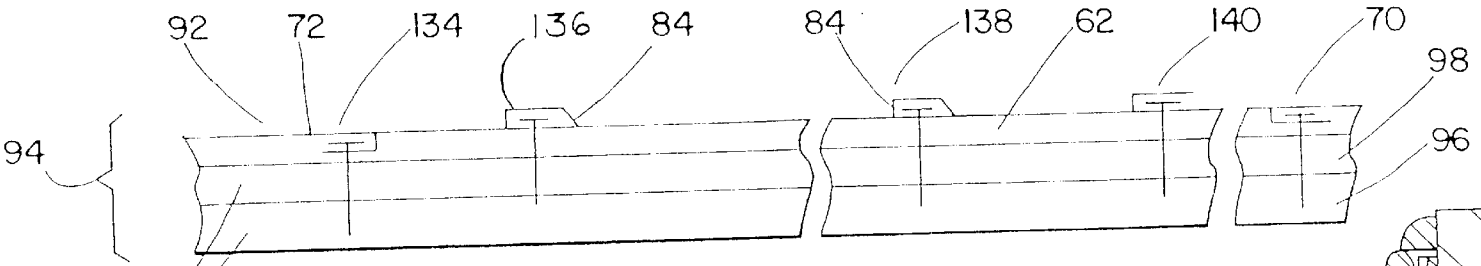
FIG. 4 is a cross-sectional view of a roof layer showing the installation of roofing material on a horizontal roof deck substrate according to the method of this invention.

The method of roofing of the present invention may be accomplished with a pre-fabricated sheet of roof membrane 92 of the present invention. A pre-fabricated sheet of roof membrane 92 is comprised of: a sheet of roofing material 62; tabs 74, 76 affixed to the underside surface 78 of the roofing material 62; and tabs 84 affixed to the exterior surface 72 of the roofing material 62, where the tabs 74, 76, 84 are positioned at a predetermined distance in relation to each other. Additionally, as illustrated in FIGS. 2 and 4, the tabs 84 affixed to the exterior surface 72 of the roofing material 62 are placed along a length of the roofing material 62 and between the tabs 74, 76 affixed to the underside surface 78 of the sheet of roofing material 62.

The length and width of the pre-fabricated sheet of roof membrane 92 will vary based on the width or height of the roofing surface. The sheet of roof membrane 92 can also be standardized to a no material waste standard size that a contractor can fit in the center of a roof, while making the appropriate fitting measurements at the perimeters of the roof. This process will standardize the sheets and cut material costs. Various known materials can be used to manufacture the sheet of roof membrane 92 of the present invention.

Figure 2:
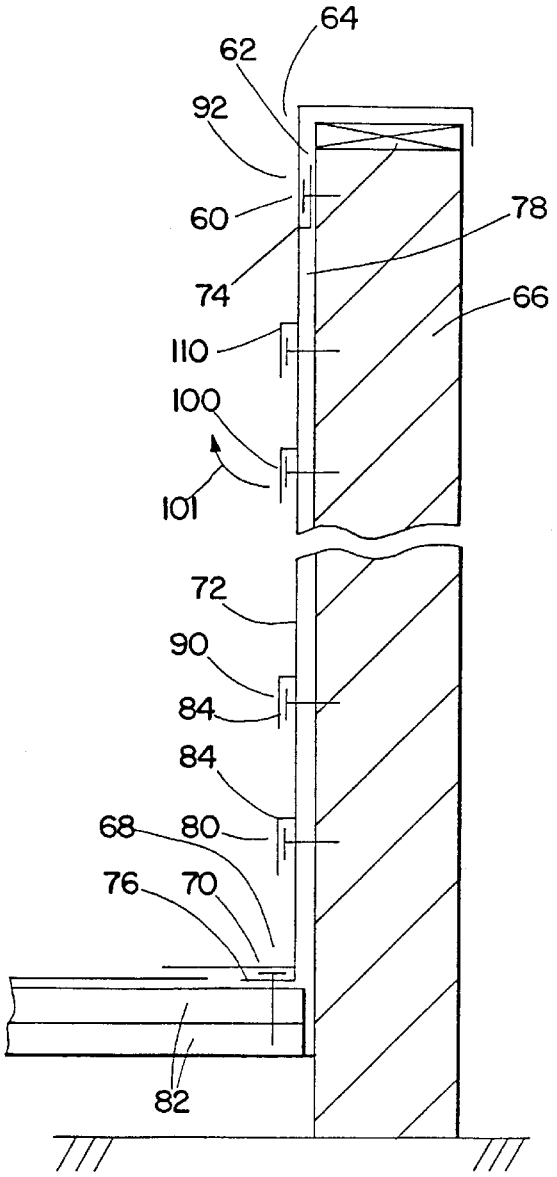
FIG. 2 is a cross-sectional view of a parapet showing the installation of roofing material on a parapet and a portion of the horizontal roof deck substrate according to the method of this invention.

FIG. 2 illustrates the installation of a roof membrane 92 onto a parapet (or wall 66) using the method of this invention. The first fastener is installed at 60 and the second at 70 using via the tabs 74, 76 attached to the underside of the material 62. A predetermined number of intervening fasteners are installed directly through the roofing material 62 into the wall 66 at 80, 90, 100 and 110. (The number of intervening fasteners required may vary depending on the particular installer, the thickness and length of the roofing material 62, and the type of roofing material 62 and fastener used.) Once the intervening fasteners are driven into the wall 66, tabs 84, or plates, affixed to the exterior surface 72 of the roofing material 62, are folded down on the fasteners. The perimeters of the tabs 84 are then field-welded, or otherwise sealed, closed to prevent moisture from penetrating the hole made by the fastener.

Referring to FIG. 2 in more detail, the roofing method of the present invention is accomplished by: first fastening the roof membrane 92 of the present invention to the top 64 of a wall 66; then fastening the roofing material 62 at a location 68 near the bottom of the wall 66; and then fastening the roofing material 62 to the intervening portion of the wall 66 by fastening means, where the fastening means securing the intervening portion of the roofing material 62 are installed directly through the exterior surface 72 of the roofing material 62 and into the wall 66. The intervening portion of the wall 66 merely refers to the portion of the wall 66 between the top 64 and bottom areas 68 of the wall 66. The location 68 near the bottom of the wall where the roofing material 62 is fastened is preferably a portion of the roof substrate 82 just beyond the point where the wall 66 and the roof substrate 82 meet (e.g., tab 76 in FIG. 2).

The roofing material 62 is fastened to the top 64 of the wall 66 and to a location 68 near the bottom of the wall 66 by installing a fastening means through the tabs 74, 76 affixed to the underside surface 78 of the roofing material 62.

The present method of roofing can be performed by one worker. For example, once the tab 74 is secured at the top 64 of the wall 66, the worker may allow the roofing material 62 to hang down to the bottom of the wall 66. When a screw, or fastener, is installed at the location 68 near the bottom of the wall 66, the roofing material 62 will draw taut. Since the fastening means securing the intervening portion of the roofing material 62 is installed directly through the exterior surface 72 of the roofing material 62, an additional worker is not required to lift and hold, or pull, the roofing material 62 while the fastening means is installed.

As illustrated in FIGS. 2 and 4, the roofing material 62 of the present invention is comprised of tabs affixed to the exterior surface 72 of the roofing material 62. The tabs 84 may be folded back so that a fastener can be installed directly through the roofing material 62. (The arrow 101 in FIG. 2 shows the direction in which the tab 84 at location 100 may be folded back.) The roofing material 62 may be fastened to the intervening portion of the wall 66 by first folding back the tabs 84 before installing the fastening means directly through the exterior 72 surface of the roofing material 62 and into the wall 66. Subsequently, the tabs 84 may be folded back into position to cover the fastening means. The tabs 84 may be welded, or otherwise sealed (e.g. by glue), shut for purposes of waterproofing the roofing material 62.

Figure 3:
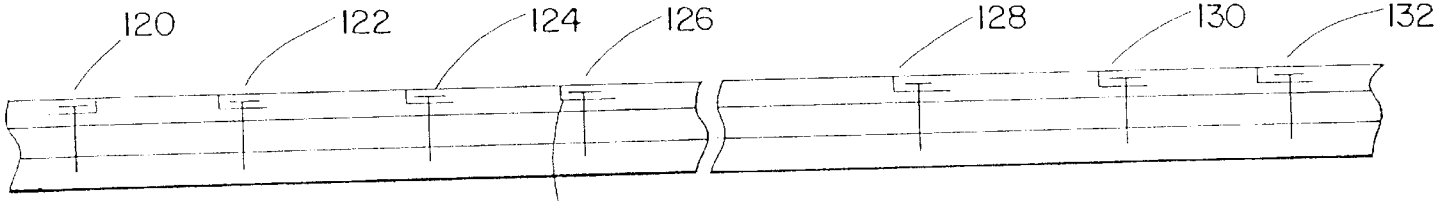
Fig. 3 (PRIOR ART)
FIG. 3 is a cross-sectional view of roof layer showing the installation of roofing material on a horizontal roof deck substrate using a method known in the art.

Once the wall 66 (or parapet) is covered with the roofing material 62, the roof substrate 82 may also be similarly covered. FIG. 3 illustrates the known method of installing roofing material on a horizontal roof substrate. The known roofing method is accomplished by fastening the roofing material at locations 120, 122, 124, 126, 128, and 132 whereby all fasteners are inserted through tabs located on the interior surface of the roofing material. The fasteners are then driven into the roof substrate 82. Again, as discussed above, these known roofing methods require at least two to three workers to complete; one for holding back the roofing material, another for pulling the tab taut, and an additional worker for fastening the roofing material to the substrate.

FIG. 4 illustrates another embodiment of the present invention showing the installation of a roof membrane 92 on a roof substrate 82 according to the method of this invention. Normally, the roof substrate 82 will be in the horizontal plane. If the roof substrate 82 is connected to a wall 66 (or parapet) which has been covered with the roof membrane 92, as discussed above, the fastener at 70 will already have been installed (see FIG. 5). In this instance, the roofing material 62 would then be fastened to the roof substrate 82 at location 134 (or at the far end of the roof substrate 82 in relation to the wall 66). The roofing material 62 would then be fastened to the intervening portion of the roof substrate 82 as will be described below.

The roof substrate 82 can also be covered with a roof membrane 92 by the method of the present invention, independently of the covering of an attached wall 66, if any. The roofing material 62 is first fastened to the roof substrate 82 at one end (either location 70 or 134) of the roofing material 62. The roofing material 62 is then fastened to the roof substrate 82 at the second end (either 70 or 134 whichever has not yet been fastened) of the roofing material 62. Once the ends 70, 134 have been fastened, the roofing material 62 is fastened to the intervening portion of the roof substrate 82 by fastening means installed directly through the roofing material 62 and into the roof substrate 82. (Again, the intervening portion of the roof substrate 82 is merely the portion of the roof substrate 82 between the end locations 70, 134.)

Again, as illustrated in FIGS. 2 and 4, the roof membrane 92 is comprised of roofing material 62 which is further comprised of tabs 84 placed on its exterior surface 72. The tabs 84 may be folded back to expose the exterior surface 72 of the roofing material 62. The roofing material 62 may be fastened to the intervening portion of the roof substrate 82 by first folding back the tabs 84 before installing the fastening means directly through the roofing material 62 and into the roof substrate 82. Subsequently, the tabs 84 can then be folded back into position to cover the fastening means. The tabs 84 may then be field-welded, or otherwise sealed, shut for purposes of waterproofing the roofing material 62. All remaining fasteners at locations 136, 138, and 140 may be installed according to this method. Accordingly, the method of the present invention saves considerable time and money from the known roofing techniques by enabling one worker to pull the roofing material 62 taut one-time per sheet as opposed to one tab at a time.

FIG. 4 illustrates a roof layer, or deck sheet 94 (i.e., a roof substrate 82 which has been covered with a prefabricated sheet of roof membrane 92) of the present invention. The deck sheet 94, is comprised of a roof substrate 82 and a sheet of roof membrane 92 covering the roof substrate 82. The roof substrate 82 may be comprised of a deck layer 96 and an insulation layer 98.

Figure 5:
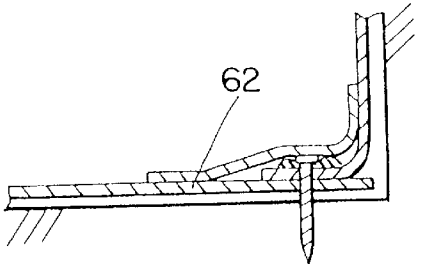
FIG. 5 is a cross-sectional view of a plate and fastener in use in fastening the roofing material to the roof substrate.
Figure 6:
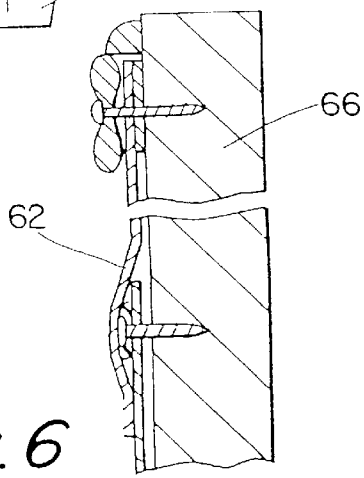
FIG. 6 is a cross-sectional view of a fastener in use in fastening the roofing material to a parapet.

FIGS. 5 and 6 illustrate cross-sectional views of different types of fasteners, in use, that may be used to fasten the roofing material 62 to a roof substrate 82 or wall 66.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A roof membrane, comprised of:

a sheet of roofing material;

at least one tab affixed to an underside surface of said sheet of roofing material;

at least one tab affixed to an exterior surface of said sheet of roofing material, wherein said tab affixed to an exterior surface of said sheet of roofing material is adapted to be folded away from said roofing material to allow the installation of a fastener through said roof membrane and wherein said tab affixed to an exterior surface may be welded to said roofing material to cover said fastener installed through said roof membrane.

2. A roof membrane according to claim 1, wherein said tab affixed to an exterior surface of said sheet of roofing material is adapted to be heat welded to said sheet of roofing material.

3. A roof membrane according to claim 1 wherein said tabs are placed along a length of said roofing material.

4. A roof membrane, comprised of:

a sheet of roofing material;

at least one tab affixed to an exterior surface of said sheet of roofing material, wherein said tab is adapted to be folded away from said roofing material to allow the installation of a fastener through said roof membrane and wherein said tab is adapted to allow welding of said tab to said roofing material to cover said fastener installed through said roof membrane; and a tab fixed to an underside portion of said roofing material, said tab fixed to an underside portion of said roofing material being attached to an end of said sheet of roofing material.

* * * * *